United States Patent [19]

Venäläinen

[11] 4,070,899

[45] Jan. 31, 1978

[54] METAL DEFORMING APPARATUS FOR PURPOSES SUCH AS AUTOMOBILE REPAIRS

[76] Inventor: Teuvo Olavi Venäläinen, Luistelijantie 9, 70200 Kuopio 20, Finland

[21] Appl. No.: 730,667

[22] Filed: Oct. 7, 1976

[51] Int. Cl.[2] ..... B21D 1/12

[52] U.S. Cl. ..... 72/457; 72/705

[58] Field of Search ..... 72/705, 457, 447, 306; 254/88, 89 R, 89 H, 93 L; 187/8.43, 8.45, 8.47, 8.49

[56] References Cited

U.S. PATENT DOCUMENTS

| | | | |
|---|---|---|---|
| 1,973,803 | 9/1934 | Frauen | 254/88 |
| 2,576,544 | 11/1951 | Smith | 72/388 |
| 3,492,855 | 2/1970 | Wylie | 72/705 |
| 3,691,817 | 9/1972 | Friend et a. | 72/705 |
| 3,776,022 | 12/1973 | Lionello | 72/705 |
| 3,888,100 | 6/1975 | Chisum | 72/705 |

FOREIGN PATENT DOCUMENTS

| | | | |
|---|---|---|---|
| 2,145,992 | 9/1971 | Germany | 72/705 |
| 2,507,412 | 8/1975 | Germany | 72/705 |
| 2,246,883 | 4/1974 | Germany | 72/705 |

*Primary Examiner*—Michael J. Keenan
*Attorney, Agent, or Firm*—Steinberg & Blake

[57] ABSTRACT

A metal deforming apparatus to be used for purposes such as automobile repairs. A frame of the apparatus carries a vertically movable support structure which in turn carries a gripping structure for gripping a part such as a vehicle body which is situated over the vertically movable support structure, a suitable structure being provided for vertically moving the vertically movable support structure with respect to the frame. A horizontal telescopic beam assembly is carried by the frame and is capable of having its length changed by a beam moving structure. A clamp is provided for clamping a part which is to be deformed or for clamping a tool which is to act on such a part. A positioning structure carries the clamp and is connected with the beam assembly for adjusting the position of the clamp. The structure which moves the vertically movable support with respect to the frame is capable of applying vertical pushing or pulling forces to a part which is to be deformed while the structure which changes the length of the telescopic beam assembly is capable of applying horizontal pushing or pulling forces to the part which is to be deformed.

16 Claims, 11 Drawing Figures

FIG.7
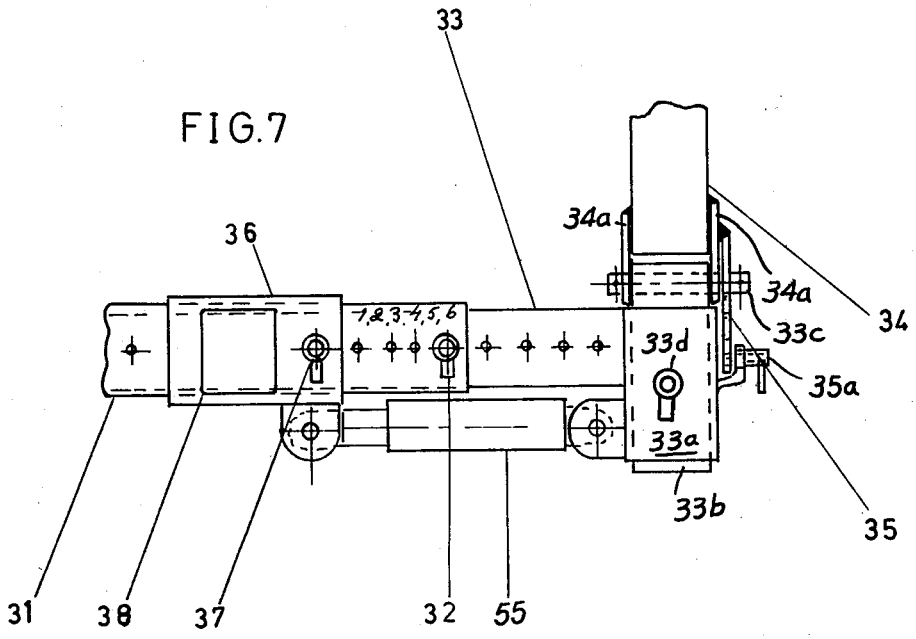
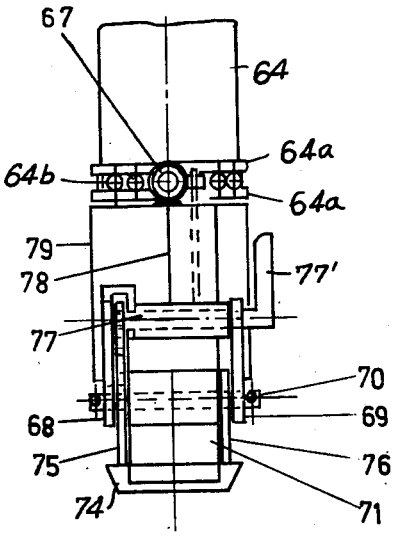
FIG. 10

FIG. 8
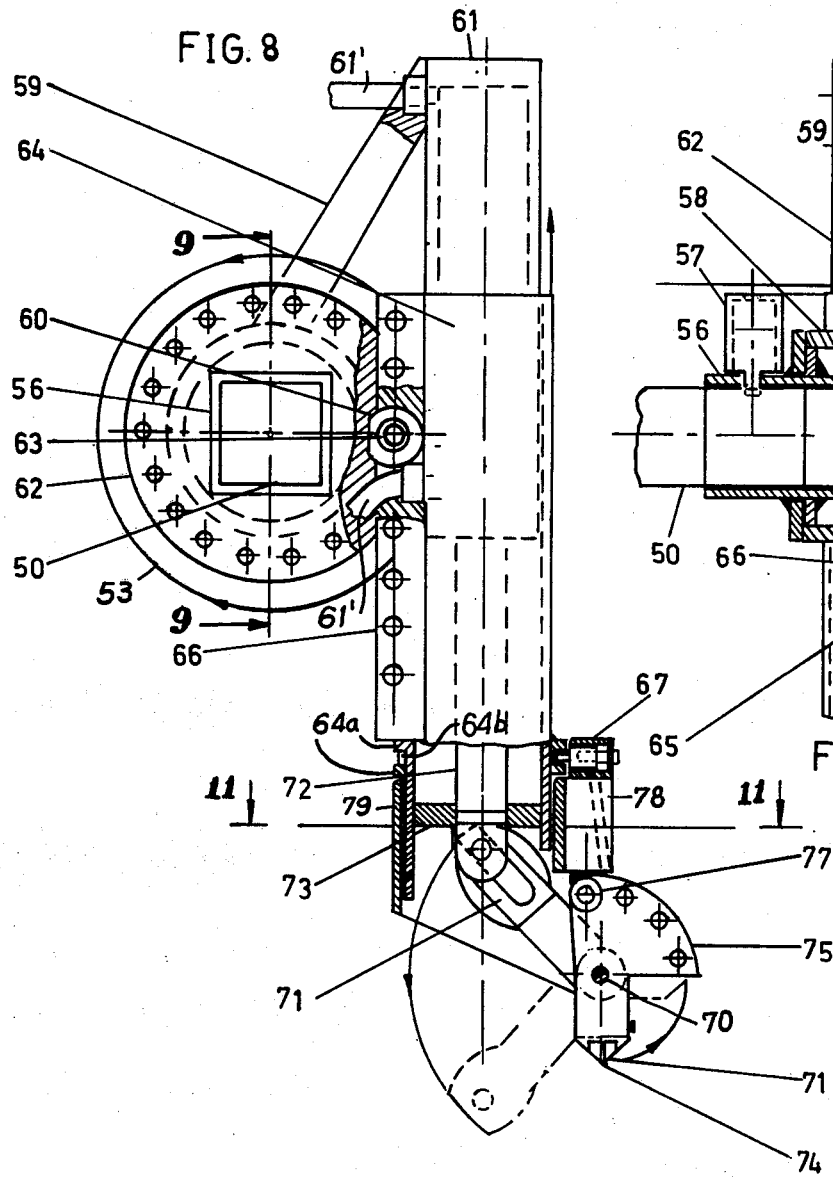
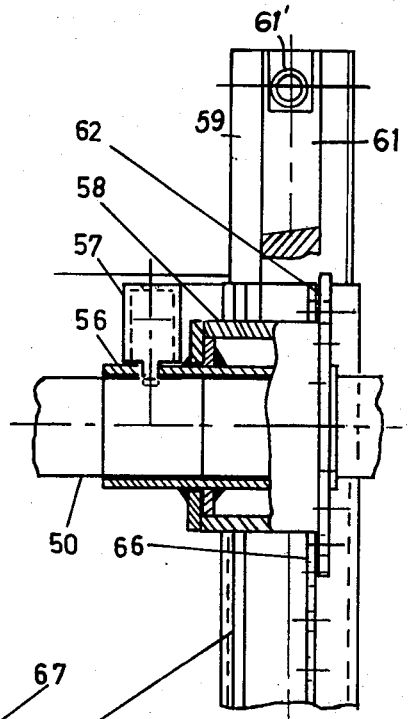
FIG. 9
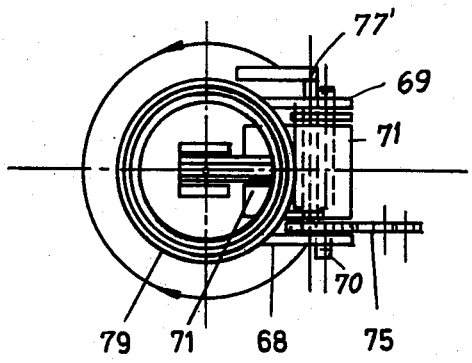
FIG. 11

METAL DEFORMING APPARATUS FOR PURPOSES SUCH AS AUTOMOBILE REPAIRS

BACKGROUND OF THE INVENTION

The present invention relates to metal deforming apparatus and in particular to an apparatus of this type which is suitable for purposes such as automobile repairs.

Thus, the present invention relates to a car chassis jack that can be utilized in rectifying, servicing and repair work on automobiles.

The apparatus of the invention includes a frame which is preferably mounted on wheels and which includes a rectifying table provided with body gripping means, a linkage mechanism being connected to the rectifying table for tilting and raising the latter, while a rectifying unit is provided, the latter having a rectifying beam system and a rectifying head.

Previously known rectifying or metal-deforming devices require an apparatus which is situated below floor level so that an automobile may be positioned over the apparatus. Also, there are known apparatus having wheels and capable of being pushed beneath an automobile with lifting of the automobile being provided by way of a special jack. However, these devices do not include the capability of adjusting the working height. In order to fix the automobile to the apparatus which is known slow tedious work is required because the gripping jaws have a plurality of bolts and securing thereof to the vehicle at the proper locations laterally and longitudinally of the vehicle requires operation of a large number of bolts.

Furthermore, with known apparatus of the above general type it is necessary to pull on an elongated member by way of a tightening jaw which has a bolt-tightening action. Also, there is known in the prior art apparatus wherein a rectifying beam is rotatably supported at a central part of a bench and is capable of being horizontally adjusted in a radial direction. Devices of this type have a serious drawback in that the rectifying movement is confined to radial directions. Moreover, there is a known apparatus wherein a pulling beam is fixed by bolts at various pulling angles. The known apparatus cannot provide pushing forces and the operations required with the known apparatus are slow and cumbersome.

SUMMARY OF THE INVENTION

It is accordingly a primary object of the present invention to provide an apparatus of the above general type which will avoid the above drawbacks.

Thus, it is an object of the present invention to provide an apparatus of the above type according to which a structure such as a automobile can be very conveniently mounted on the apparatus to be worked on.

In addition, it is an object of the invention to provide for an apparatus of the above type clamps which can quickly and conveniently be set in a limitless number of positions.

Furthermore, it is an object of the invention to provide an apparatus which is capable of applying both pushing and pulling forces in both vertical and horizontal directions in a highly convenient manner.

Yet another object of the present invention is to provide a construction which makes it possible to utilize the structure which raises and lowers the vehicle for applying vertical pushing and pulling forces.

The objects of the present invention also include an apparatus which may be utilized not only for metal deforming in automobile repair shops, but also upon removal of metal-deforming units for purposes such as various servicing and repair operations on the chassis of a vehicle.

Furthermore, it is an object of the present invention to provide an apparatus according to which an automobile may be quickly and easily fixed to the apparatus simply by driving the automobile onto an inclined support which can then be tilted and raised while the automobile is supported only through gripping means on a support structure.

Yet another object of the present invention is to provide a gripping structure which requires only a single nut to be operated for tightening the gripping structure so as to fix its position as well as to bring about the gripping action.

It is also an object of the present invention to provide an apparatus of the above type with plates which can be maintained on the apparatus for general servicing and repair operations while such plates can easily be removed for metal deforming operations.

With the apparatus of the invention, the pushing and pulling forces which act horizontally are brought about in all directions by way of a beam system which extends beneath and to both sides of the vehicle.

It is a further object of the present invention to provide the beam system with adjustable clamping heads which can be applied in any number of different positions with respect to the parts which are to be deformed.

It is furthermore an object of the present invention to provide a construction which is capable of bringing about the metal-deforming operation simultaneously at a number of different points, while also capable of being operated so as to maintain stationary parts which are not to be deformed.

Moreover, it is an object of the present invention to provide an apparatus of the above type with a system of releasable locks according to which it is possible to secure a part in a given position while deforming work is carried out at another part.

In addition it is an object of the present invention to provide a structure of the above type with a means according to which the extent of movement of the parts can easily be measured.

According to the invention the metal deforming apparatus includes a frame means and a vertically movable support means connected to the frame means for vertical movement with respect thereto, a vertical moving means being operatively connected with the vertically movable support means to move the latter vertically with respect to the frame means. This vertically movable support means carries a gripping means for gripping a body of a vehicle so that in this way it is possible to maintain the vehicle stationary with respect to the vertically movable support means while the latter can be operated on to situate the vehicle at a selected elevation. A telescopic beam means which can have its length adjusted is fixedly carried by the frame means while a beam moving means is connected to this telescopic beam means for changing the length thereof. A clamping means is provided for clamping either a part which is to be deformed or a tool for acting on such a part, and a positioning means carries the clamping means and is connected with the telescopic beam means for situating the clamping means at a selected position.

The beam-moving means is operable for applying horizontal pushing or pulling forces to the part which is to be deformed while the vertical moving means is operable to provide vertical pushing or pulling forces to the part which is to be deformed.

BRIEF DESCRIPTION OF DRAWINGS

The invention is illustrated by way of example in the accompanying drawings which form part of this application and in which:

FIG. 7 is a fragmentary side elevation of part of the structure shown at the lower right of FIG. 2, this structure being shown in FIG. 7 at a larger scale and with more detail;

FIG. 8 is a schematic partly sectional elevation of a clamping means and a positioning means cooperating therewith;

FIG. 9 is a fragmentary partly sectional elevation of the structure of FIG. 8 taken along line 9—9 of FIG. 8 in the direction of the arrows;

FIG. 10 is a fragmentary elevation of the structure shown at the lower part of FIG. 8, as seen from the right of FIG. 8; and FIG. 11 is a partly sectional plan view of the structure of FIG. 8 taken along line 11—11 of FIG. 8 in the direction of the arrows.

DESCRIPTION OF PREFERRED EMBODIMENTS

Figure 1:
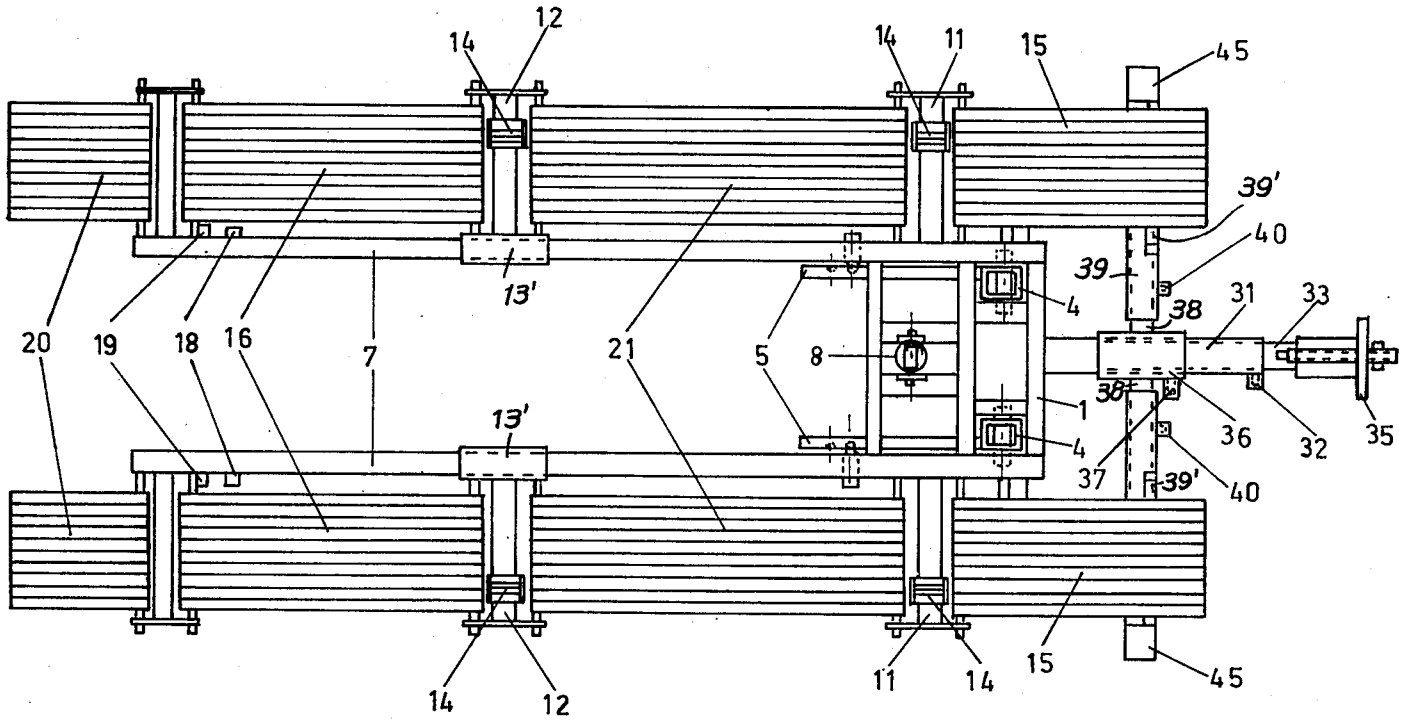
FIG. 1 is a schematic top plan view of an apparatus according to the invention.
Figure 2:
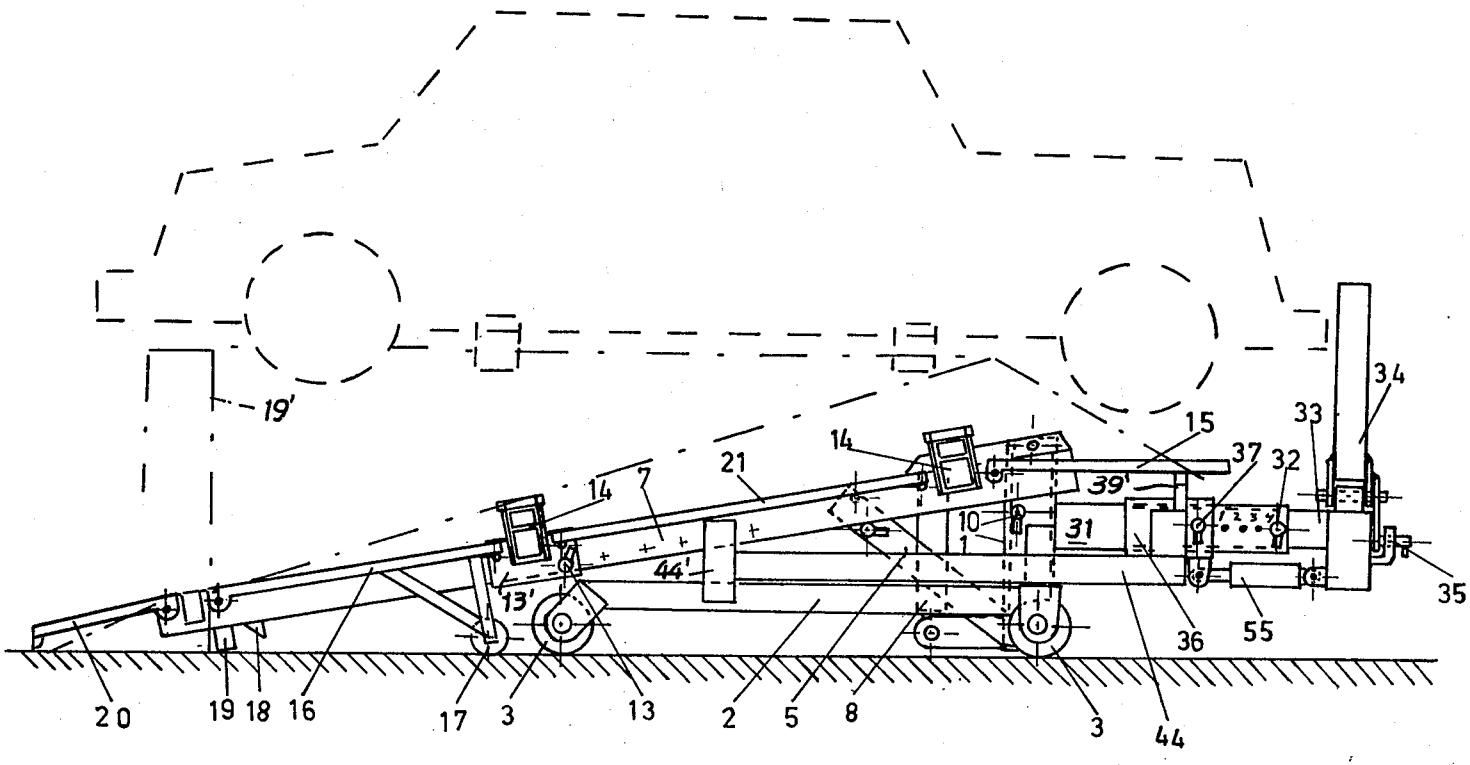
FIG. 2 is a schematic side elevation of the apparatus of FIG. 1 showing in phantom lines an automobile mounted at an elevated position.

Referring now to FIGS. 1 and 2, there is schematically illustrated therein a frame means 1 which includes a pair of vertical tubular beams reinforced by transversely extending horizontal beams fixed to the vertical tubular beams at their upper and lower ends. This frame means 1 also includes a pair of horizontal beams 2 which are fixed to and extend rearwardly from the pair of vertical tubular beams of the frame means 1. These beams 2 are fixed to the lower portion of the frame means 1.

Each of the horizontal beams 2 carries at its front and rear ends a pair of wheels 3 so that by way of the wheels 3 the frame means 1 is supported for travelling movement.

A vertically movable support means is operatively connected to the frame means 1 for vertical movement with respect thereto. This vertically movable support means includes a pair of vertical tubular means 4 which are respectively situated with suitable clearance within the tubular vertical beams of the frame means 1 so as to be vertically movable with respect thereto. The pair of vertical beams 4 are respectively fixed at the lower ends to a pair of upwardly inclined beams 5 which extend upwardly toward the left, as viewed in FIGS. 2 and 3. Thus these beams 5 are respectively fixed integrally at their lower ends to the pair of tubular beams 4. The left walls of the tubular beams of the frame means 1 which respectively receive the tubular beams 4 are respectively formed with vertical slots in which the lower end regions of the inclined beams 5 are freely movable. By way of pivot pins 6 the upper ends of the tubular beams 4 of the vertically movable means are pivotally connected with elongated beams 7 which extend rearwardly from the beams 4 and which extend across the inclined beams 5. Thus by way of the pivots 6 the pair of beams 7 of the vertically movable means are tiltable with respect to the vertical beams 4 thereof, these beams 7 forming part of a tiltable ramp means as will be apparent from the description which follows.

A vertical moving means is provided for bringing about the vertical movement of the vertical support means 4–7 with respect to the frame means 1. This vertical moving means includes the hydraulic assembly 8 made up of a suitable piston and cylinder, the latter being connected with a suitable source of hydraulic fluid under pressure in a manner which is not illustrated. The lower end of the hydraulic unit 8 is pivotally connected with a rigid brace structure which is fixed to and forms part of the frame means 1. The upper end of the unit 8 is pivotally connected with a framework which extends between and is fixed to the pair of beams 7. Thus, when hydraulic fluid under pressure is supplied to the unit 8 so as to expand the latter, the pair of beams 7 will turn in a clockwise direction, as viewed in FIGS. 2 and 3, about the axis formed by the pivots 6, while when the unit 8 contracts, the beam 7 will turn downwardly around the pivots 6.

A releasable lock means is provided for releasably locking the beams 7 in the horizontal position to which they are raised. This releasable lock means includes lock bolts 9 supported for longitudinal movement in sleeves fixedly carried by the beams 7, these lock bolts 9 having free ends capable of being moved into and out of openings formed in the inclined beams 5. Thus, through the lock means 9 it is possible quickly and easily to unlock the beams 7 from a given position with respect to the beams 5 and to lock them in a given position with respect to the beams 5.

In order to hold the vertically movable support means 4–7 in a selected vertical position, a releasable lock means 10 is provided. This lock means 10 can have the same construction as the lock means 9. Thus the lock means 10 may include a pair of sleeves fixed to and projecting laterally from the frame means 1 and housing slide bolts which can be situated in openings formed along the pair of beams 4 so that by selecting suitable openings of the beams 4 to receive the lock means 10, the vertical support means can be fixedly held with respect to the frame means 1 in a selected vertical position.

The beams 7 of the vertical support means carry beams 11 and 12 which project horizontally and laterally from the beams 7 and in the manner which is most clearly apparent from FIG. 1. In the illustrated example the beams 11 are directly fixed to the beams 7 while projecting laterally therefrom. The beams 12, however, are fixedly mounted on sleeves which are slidable along the beams 7, these beams being capable of being fixed at selected positions along the beams 7 by way of lock pins 13 which pass through openings of these sleeves and can be received in selected openings situated along the beams 7, as schematically illustrated in FIG. 2. Each of the beams 11 and 12 carries a gripping means 14 for gripping a body part of an automobile.

The vertically movable support means includes, as indicated above, a ramp means which is formed in part by the beams 7 and which is tiltable about the axis formed by the pivots 6 in the manner described above. This ramp means further includes a plate means onto which the wheels of the vehicle can travel when the vehicle travels onto the ramp means. The plate means includes a pair of front plates 15 which at their rear ends are pivoted to horizontal rods fixed at their inner ends to the beams 7 and at their outer ends to a pair of plates which are fixed to the outer ends of the horizontal beams 11. The front end regions of the plates 15 rest on structure described below and situated in front of the frame means 1. Thus, as is shown schematically in FIGS. 1 and 2, the frame means 1 fixedly carries a beam assembly a part of which projects laterally beneath the plates 15 and on which these plates rest.

The plate means includes a pair of rear plates 16 supported at their front ends by way of wheels 17, as shown schematically in FIG. 2. These plates 16 are pivotally connected at their rear end regions to a pair of rods which are fixed to and extend laterally from the rear end regions of the beams 7, as shown in FIGS. 1 and 2. Fixed to the outer surfaces of the beams 7 at the region of the rear ends of the plates 16 are blocks 18 and 19 which can be engaged with supporting structures of a suitable height situated beneath the rear end regions of the beams 7 and engaging the rods 18 and 19 after the vertically movable support means have been situated at a selected elevation. A suitable supporting structure 19' for engaging with the blocks 19 in the elevated position of the vertically movable support means is schematically shown in phantom lines in FIG. 2. For the purpose of providing greater ease in driving an automobile onto the ramp means or rectifying table, a pair of rear plates 20 are provided, these plates 20 being freely swingable on horizontal rods which are fixed to and project laterally from the extreme rear regions of the beams 7. The plate means also includes a pair of plates 21 which extend between the beams 11 and 12 in the manner most clearly apparent from FIG. 1. It will be seen that the front ends of the plates 16 rest on a pair of rods which are fixed to and project laterally from the sleeves 13' which are slidable on the beams 7 and which fixedly carry the beams 12. Of course it is to be understood that the beams 7 as well as the sleeves 13' are of a non-circular cross section such as a rectangular cross section, for example, so that the sleeves 13' cannot turn about the beams 7. Thus the sleeves 13' can only shift longitudinally along the beams 7. These sleeves 13' fixedly carry front transverse rods which support the rear ends of the plates 21. The front ends of the latter are supported on rods situated just to the left of the fixed beams 11 and which are fixed to and project laterally from the beams 7 in the manner shown in FIG. 1. The plates 21 are easily removable from the rods which support the same. For this purpose the plates 21 may fixedly carry at their lower surfaces substantially U-shaped spring clips which can easily be snapped onto and removed from the rods which temporarily support the plates 21.

Figure 3:
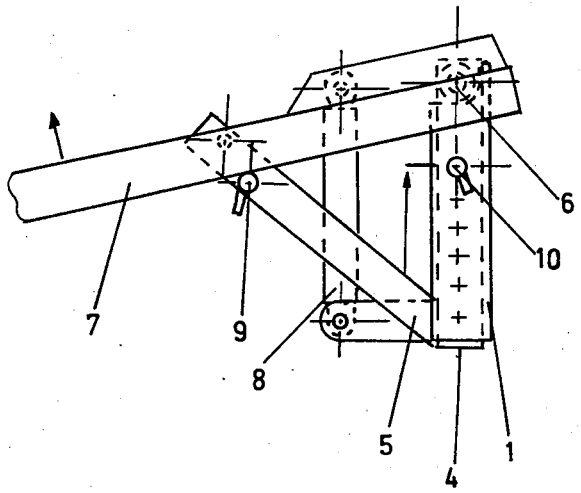
FIG. 3 is a fragmentary side elevation of the structure for situating the work at a selected elevation.

As is clearly shown in FIG. 3, it is possible by expanding the hydraulic vertical moving means 8 to tilt the beams 7, and thus all of the structure supported thereby, to a horizontal position, and the lock means 9 can be manipulated to lock the beams 7 in this horizontal position. With the locks 9 thus locking the beams 7 in their horizontal position, the locks 10 are moved to their unlocking position and the vertical moving means 8 is further expanded to raise the entire vertically movable support means 4–7 with respect to the frame means 1 to a selected elevation, where the lock means 10 are returned to their locking position locking the beams 4 at the selected elevation.

Figure 4:
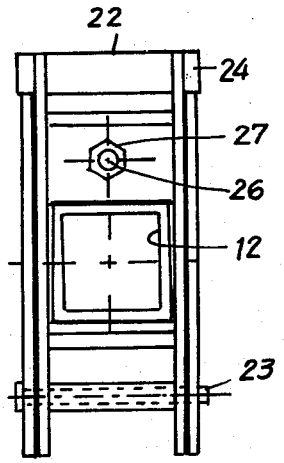
FIG. 4 is an elevation of a gripping means of the invention.
Figure 5:
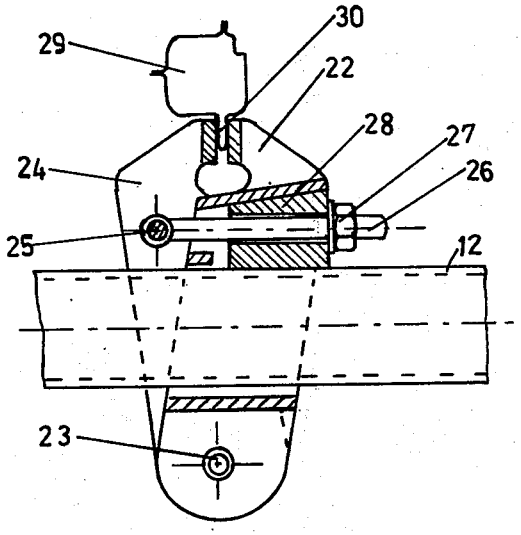
FIG. 5 is a partly sectional side elevation of the gripping means of FIG. 4.

The several gripping means 14 are all identically constructed. The details of one of the gripping means 14 are illustrated in FIGS. 4 and 5, the particular gripping means of FIGS. 4 and 5 being shown on one of the laterally extending beams 12. Referring to FIGS. 4 and 5 it will be seen that each gripping means 14 includes a first gripping jaw 22 which is supported by the beam 12 for movement longitudinally thereof. This jaw 22 has a pair of side plates between which the beam 12 extends, and these side plates are fixed to transverse plates which are situated above and below the beam 12. The lower end regions of the side plates of the jaw 22 are fixed to a sleeve through which a pin 23 passes, this pin 23 extending laterally beyond the side plates of the jaw 22 and serving to pivotally support a pair of side plates of a cooperating gripping jaw 24. These side plates of the jaw 24 are fixed to each other at their upper ends by a transversely extending gripping member which faces a transversely extending gripping member of the jaw 22. It is between these gripping members that the lower portion 30 of the elongated body or chassis part 29 is gripped. Thus, as is well known, a conventional automobile has at its opposite sides lower elongated beams 29 which have the depending portions 30 which can conveniently be gripped as indicated in FIG. 5 in a schematic manner.

All of the parts of the gripping means are made of rugged substantially rigid metal components. The side plates of the jaw 22 are interconnected beneath the gripping member extending therebetween by a transversely extending member which is inclined with respect to the beam 12 and which rests on the upper inclined surface of a wedge 28 which is axially bored as shown in FIG. 5. The pair of side plates of the jaw 24 fixedly carry coaxial sleeves which receive the opposed ends of a transverse pin 25 which at its central region is fixed to a bolt 26 which passes freely through the axial bore of the wedge 28 and which has threads on which the nut 27 is mounted. When this nut is loosened the entire gripping means can be shifted longitudinally along the beam 12. By tightening the nut 27 it is possible not only to bring the jaws 22 and 24 into gripping engagement with the body part 29 but also to simultaneously act on the wedge 28 for clamping the gripping means to the beam 12 in the manner most clearly shown in FIG. 5. Thus, through this simple operation of the single nut 27 it is possible simultaneously to fix the position of the gripping means and to place it in its gripping engagement with the body part 29.

Referring now to FIGS. 1, 2, 6, and 7, a telescopic beam means forming part of the structure of the invention is illustrated therein. The telescopic beam means includes a longitudinal beam means which extends longitudinally with respect to a vehicle gripped by the gripping means 14 while the lateral telescopic beam means extends laterally with respect to such a vehicle. Thus the longitudinal beam means extends parallel to the beams 7 while the lateral beam means extends parallel to the beams 11 and 12.

In the illustrated example the longitudinal telescopic beam means is fixedly carried by the frame means 1. This longitudinal telescopic beam means includes an elongated hollow tubular beam 31 of non-circular cross section, such as a square cross section. This beam 31 is fixed at its left or rear end, as viewed in FIG. 1, to the frame means 1, and of course the beam 31 extends forwardly from the frame means 1 while having the elevation which is apparent from FIG. 2. Slidable within the hollow beam 31 is an elongated beam 33 of the same cross-sectional configuration as the beam 31, this beam 33 thus being longitudinally slidable with respect to the beam 31 so as to extend by a selected distance forwardly from the beam 31. A side wall of the hollow beam 31 carries a lock means 32 in the form of a slide bolt or the like. This lock 32 is adapted to be passed through aligned openings in the side walls of the beams 31 and 33 so as to fix the latter at a given position with respect to the beam 31.

The beam 33 of the longitudinal telescopic beam means fixedly carries at its front end a vertically extending hollow tubular member 33*a* in which an elongated vertically extending tube or block 33*b* is slidable and fixed in any suitable way as by slide bolt 33*d* carried by member 33*a* and capable of being placed in one of a vertical row of openings formed in member 33*b*. At its upper end region the member 33*b* is formed with an axial bore which receives an elongated pin 33*c*. Situated over the member 33*b* is an elongated beam 34 which at its bottom end is fixed with a pair of lugs 34*a* between which the top end of member 33*b* is received. The pin or bolt 33*c* also extends through these lugs 34*a*, so that in this way the beam 34 is connected to the front end of the beam 33 for swinging movement in the direction of the arrows indicated in FIG. 6 to one side or the other through approximately 90°. The front lug 34*a* shown in FIG. 7 fixedly carries a semicircular plate 35 which is formed along its peripheral edge with a series of openings shown in FIG. 6. The front wall of the member 33*a* carries a lock means 35*a* in the form of a slide bolt which can be selectively situated in one of the openings of the plate 35 so as to fix the beam 34 in a selected angular position about the axis of the pin 33*c*. This beam 34 is adapted to carry a positioning means, of the type described below, and this positioning means in turn is adapted to carry a clamping means of a type described below, so that in this way it is possible to situate a clamping means at a selected location for purposes referred to below. For the sake of clarity the positioning means and clamping means which cooperate with the swingable beam 34 are not illustrated. It will be noted, however, from FIG. 6 that the beam 34 is formed with a plurality of openings distributed longitudinally therealong so that a sleeve can slide along the beam 34 to position a clamping means at a selected elevation.

The lateral telescopic beam means includes a sleeve 36 which surrounds the beam 31 and is of the same cross-sectional configuration as the beam 31, this beam 36 being longitudinally slidable along the beam 31. As is apparent from FIG. 7 the beam 36 carries at its front end a lock means 37 in the form of a slide bolt capable of being selectively received in one of the numbered openings of the beam 31 shown at the upper right portion of the beam 31 as viewed in FIG. 7. Thus in this way it is possible to situate the sleeve or beam 36 of the lateral telescopic beam means at a selected location along the beam 31 which is fixed to the frame means 1.

The opposed side walls of the sleeve or beam 36 fixedly carry a pair of coaxial lateral beams 38, the latter being, for example, welded at their inner ends to the opposed side walls of the sleeve 36. These beams 38 extend into and slidably support elongated tubular beams 39 which thus form together with the beams 38 the lateral telescopic beam means. Each of the beams 39 is formed at its front wall with a plurality of openings in one of which a bolt 40 can be situated, this bolt 40 also passing into an opening in a side wall of the beam 38 which slidably supports the beam 39. Of course these beams 38 and 39 are of matching non-circular cross section and are in the form of hollow tubular members. Thus, by way of the locks 40 it is possible to fix the beams 39 at selected positions along the beams 38. It will be seen from FIG. 6 that the beams 38 carry graduations cooperating with the inner ends of the beams 39 so as to indicate to the operator the positions of the beams 39 and along the beams 38.

The top walls of the beams 39 fixedly carry suitable supports 39' on which the plates 15 rest at the region of the front ends of the plates 15.

Figure 6:
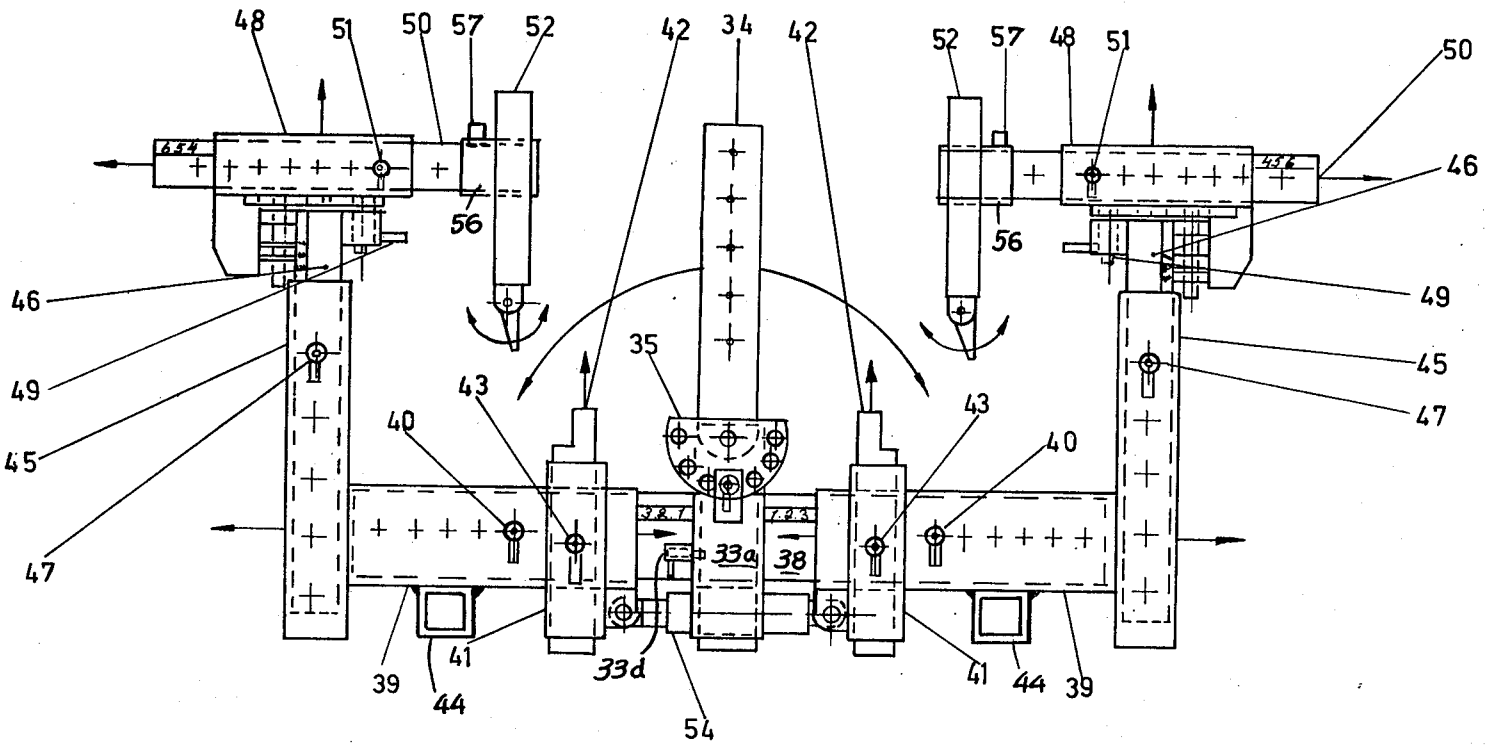
FIG. 6 is a front end elevation of the structure of FIGS. 1 and 2 as seen from the right thereof.

In addition, the beams 39 fixedly carry at their front walls vertically extending tubular members 41 shown only in FIG. 6 for the sake of clarity. These tubular members or housings 41 are, for example, welded to the front walls of the sleeves or tubes 39. Elongated bars 42 are vertically slidable respectively in the housings 41, the latter carrying slide-bolt types of locks 43 capable of being situated in one of a row of vertical openings formed in each of the vertically extending bars 42. Thus, the bars 42 can in this way be situated at a selected elevation while of course their lateral positions can be determined by determining the lateral positions of the tubes 39. These members 42 are part of a straightening means. In a manner which will be apparent from the description below the members 42 can be situated at a suitable elevation for engaging part of an automobile or the like which is carried by the support means, and then through moving means described below it is possible to act on the members 42 so as to displace them in a desired direction so that it is possible this way to apply deforming forces on a part of the vehicle to contribute to the repair thereof.

A pair of longitudinal beams 44 are fixed to the bottom walls of the members 39 as by being welded thereto. These beams 44 extend rearwardly past the frame means 1 so as to terminate beneath the plates 21 which are removable as pointed out above. At their rear ends the beams 44 fixedly carry housings 44' which are adapted to support a pair of positioning means which in turn are adapted to carry clamping means of the type described below, this structure carried by the housings 44' not being illustrated for the sake of clarity. However, by way of this structure it is possible to carry out operations at a part of a vehicle situated to the rear of the frame means.

At their outer ends the pair of hollow beams 39 fixedly carry vertically extending housings 45 which are closed at their bottom ends so as to carry in their interiors at these bottom ends compressed springs which act on vertical members 46 which are slidable respectively in the housings 45. In this way these members 46 are springloaded. A pair of locks 47 in the form of suitable slide bolts are capable of being selectively received in one of the series of vertical openings formed in each of the vertical members 46 so in this way the latter can be fixed at a selected elevation. These members 45 and 46 form part of a positioning means carried by the lateral telescopic beam means and further including a horizontal guide member 48 situated over each of the vertical members 46 which of course are respectively guided by the tubular housings 45. The horizontal tubular guide members 48 are turnably mounted on the top ends of the vertical members 46 so as to be turnable about the vertical axes thereof, respectively. These guides 48 are capable of turning through an angle of approximately 180°. Lock means 49 are provided for locking the tubular guides 48 in selected angular positions, respectively. Thus, the lock means 49 takes the form of vertically slidable bolts mounted on the top ends of the vertical members 46 and capable of being selectively received in one of a circular row of openings formed in a plate which is horizontal and fixed to the bottom walls of the tubular guides 48. The center of this plate is situated vertically beneath the axis of each tubular guide 48. These plates which are respectively formed with the rows of openings to selectively receive the slide bolts of the locks 49 may in turn fixedly carry vertical pins which extend into axial bores formed in the top ends of the vertical members 46. These pins at their lower end regions which are situated in such bores may be formed at their exteriors with circumferential grooves receiving the inner ends of pins which extend through wall portions of the members 46 into such circumferential grooves so that in this way while the members 48 are turnable they cannot move axially with respect to the members 46.

Elongated horizontal members 50 are respectively slidable in and extend through the guides 48, the guides 48 and elongated members 50 being of a matching non-circular cross section such as, for example, a square cross section. The guides 48 carry slide-bolt types of locks 51 capable of being selectively received in one of a series of horizontal openings formed in the members 50 so that the latter can be horizontally positioned with respect to the guides 48.

The positioning means carried by the outer end of each member 39 includes in addition to the above components 45–51, sleeves 56 of square cross section slidable along the horizontal members 50 and having the same cross section as the latter, this cross section being square in the example illustrated in FIG. 8. These sleeves 56 are capable of being fixed at selected positions along the horizontal members 50 by way of lock bolts 57 capable of being received in one of a series of openings formed at the top wall of each member 50. The sleeves 56 respectively carry the units 52 which form rectifying heads which are mechanically or hydraulically operated. The details of these rectifying heads 52 are illustrated in FIGS. 8–11. Thus, by way of the releasable lock means 57 it is possible to situate the rectifying heads 52 at selected positions along the horizontal members 50 of the positioning means.

As is illustrated most clearly at the lower central portion of FIG. 6, a pair of lateral moving means 54 are provided for changing the length of the lateral telescopic beam means 38, 39. These lateral moving means 54 are in the form of suitable hydraulic units which are preferably double acting and which receive hydraulic fluid under pressure for moving the members 39 to the right or left, as viewed in FIG. 6, with respect to the member **33*a* which is fixed to the front end of the beam 33 of the longitudinal telescopic beam means. Thus, as is shown in FIG. 6, each of the hydraulic units 54 is mounted between a lower end region of the member 33*a* and an inner end of the shiftable tubular beam 39. Through these units 54** it is possible to apply horizontal pushing or pulling forces in a lateral direction and to bring about required rectifying or metal-deforming forces which act in a horizontal lateral direction.

Referring to FIG. 7, it will be seen that a further double-acting hydraulic unit 55 is connected between the lower rear portion of the member **33*a* and lugs fixed to and extending downwardly from the lower front region of the sleeve 36. This hydraulic unit 55 is capable of receiving a hydraulic fluid so as to be expanded or contracted for changing the length of the longitudinal beam means. Of course the lock 32 at this time is in an unlocking position so that the beam 33 can be displaced with respect to the beam 31 by the action of the hydraulic unit 55**. Thus, this unit forms a longitudinal moving means for providing longitudinally extending horizontal pushing or pulling forces for the purpose of rectifying or providing metal-deforming forces. As is shown at various parts of the drawings, suitable graduated scales are situated at locations for indicating the adjusted positions of the various components. In this way precise metal-deforming operations can be carried out.

Referring now to FIGS. 8 and 9, it will be seen that the sleeve 56 supports for rotary movement a relatively short cylindrical member 58 which thus can turn around the horizontal axis of the member 50. This rotary member 58 is fixed with a rigid strut or bar 59 which is inclined upwardly to the right from the rotary member 58, as viewed in FIG. 8. At its upper end the strut or bar 59 is fixed to the top end of a cylinder 61 which forms a hydraulic unit. The cylinder 61 is a double-acting cylinder and is capable of receiving hydraulic liquid under pressure through the flexible tubes 61' indicated in FIG. 8. As is shown most clearly in FIG. 9, the rotary member 58 is situated between a pair of circular flanges which are fixed to the sleeve 56. These flanges include the front flange 62 which is formed along its periphery with a series of openings. The cylinder 61 is surrounded by an elongated tubular member 64 which is capable of moving longitudinally along the cylinder 61, this tubular member 64 thus extending transversely with respect to the rotary member 58. The tubular slide tube 64 carries at its left side, as viewed in FIG. 8, an elongated longitudinally extending flange 66 which is situated behind the circular flange 62 and which is formed with a row of openings which can be selectively aligned with an opening of the flange 62. In addition, the tube 64 carries adjacent its left side, as viewed in FIG. 9, a guide rib 65 which extends through a groove or slot formed in the member 58 so that in this way the tube 64 is guided for movement along the cylinder 61. A lock unit 60 is carried by the flange 66 and includes a lock pin 63 which can be moved into and out of aligned openings of the flange 62 and the flange 66. Thus when the lock pin 63 is not situated in such openings the entire unit formed by the cylinder 61 and the slide tube 64 thereon can be turned about the axis of the member 50. In addition the tube 64 can be shifted axially along the cylinder 61. When the sleeve 58 is situated in a desired angular position and when the tube 64 is situated in a selected position along the cylinder 61, the pin 63 may be placed through aligned openings of the flanges 62 and 66 so as to maintain the parts in the desired positions. Thus, it is possible in this way to angularly position the structure with respect to the axis of the horizontal member 50 in the manner indicated by the circular arrow 53 in FIG. 8. At the same time it is of course possible in this way also to adjust the axial position of the tube 64 along the cylinder 61.

The tube 64 which is fragmentarily illustrated in FIG. 8, fixedly carries just below the flange 66 a pair of circular rings **64*a*** defining a groove within which is situated a ring 64*b* fixed to the tube 64 and formed with a series of openings as shown most clearly in FIG. 10. The portion of the tube 64 which extends downwardly from the rings 64*a* extends slidably into a rotary cylindrical member 79 which is turnable about the axis of the cylinder 61. This rotary member 79 fixedly carries an elongated member 78 shown in FIG. 10. The member 78 in turn fixedly carries a lock means 67 of the slide-bolt type. The inner end of the lock pin is capable of being selectively received in one of the openings of the member 64*b*. This lock pin serves to support the rotary member 79 on the tube 64 while at the same time providing for selective positioning of the tube 79 angularly with respect to the tube 64.

As is shown in FIGS. 10 and 11, the rotary tube member 79 fixedly carries a pair of lugs 68 and 69 which are, for example, welded to the member 79. These lugs 68 and 69 are formed with coaxial openings through which a pin 70 passes, this pin extending horizontally between the lugs 68 and 69, as shown in FIGS. 10 and 11. This pin 70 serves to support between the lugs 68 and 69 jaws 71 and 74 of a clamping means.

The jaw 74 includes a pair of side plates 75 one of which is shown most clearly in FIG. 8. Thus, the side plates 75 of the jaw 74 have sector-shaped portions formed with openings distributed along the periphery thereof. The unit 78 which is fixed to the rotary member 79 fixedly carries at its bottom end a horizontally extending tube 77. This tube extends between the plates 75. The tube 77 has opposed ends adjacent the plates 75 and with respect to which the plates 75 are freely turnable so that openings of the plates 75 can be aligned with the tube 77. The lugs 68 and 69 are formed at upper regions with aligned openings which are coaxial with the tube 77. A lock pin 77' is adapted to be placed by the operator through the aligned openings of the lugs 68 and 69 and through the sleeve 77, while also passing through selected openings of the plates 75 so that in this way the angular position of the jaw 74 can be fixed. The jaw 74 of course includes a lower transverse portion which serves as a clamping member and which is fixed to and extends between the plates 75.

The jaw 71 has a lower clamping portion adapted to cooperate with the clamping portion of the jaw 74. This jaw 71 extends between the plates 75 while being formed with a bore which receives the pin 70. The jaw 71 has an angular configuration as illustrated in FIG. 8 and terminates at its upper region in an elongated portion formed with a slot which receives a pin fixed to the piston rod 72 of the cylinder 61. This piston rod 72 is guided through a central opening formed in a transverse plate 73 which is fixed to the interior of the guide tube 64. Thus, with this construction upon removing the lock pin 77' the operator can angularly position the jaw 74 at a selected angular position with respect to the pin 70. Then the lock pin 77' is replaced to hold the jaw 74 in the selected position. Now the cylinder 61 can receive the hydraulic fluid which acts on the piston 72 so as to swing the jaw 71 into or out of clamping engagement with respect to the jaw 74. The range of movement of these components is indicated by the solid and dotted lines in FIG. 8.

If desired the member 78 can carry a schematically indicated mechanism which can be used for simultaneously operating both the lock 67 and the pin 77', although such a construction is not required and is only optional.

It is thus apparent that with the above structure while the jaw 74 of the clamping means can be angularly positioned at a selected angular position with respect to the axis of the pin 70, the cooperating jaw 71 can be turned readily to and from a clamping position with respect to the jaw 74. In addition to this adjustment of the jaws with respect to their own turning axis, it is possible by way of the above-described positioning means to position the clamping means 71, 74 angularly about the horizontal axis of the member 50 as well as angularly about the vertical axis of the member 46. At the same time through the member 46 it is possible to adjust the elevation of the clamping means while through the member 50 it is possible to adjust the horizontal position of the clamping means. In this way it is possible it is possible to situate the clamping means of the rectifying head 52 at any required position.

As was indicated above, while the positioning means and clamping means of the invention are illustrated only at the outer ends of the members 39, it is possible to situate similar structures on the beam 34 as well as at the housings 44'.

In FIG. 2 the structure of the invention is shown in solid lines in the position it takes in preparation for receiving an automobile which is to be worked on. By way of the wheels 3 it is possible to move the entire structure of the invention very easily to any desired location. With the structure in the position of FIG. 2 the vehicle which is to be worked on can be driven up onto the ramp portion with the wheels of the vehicle resting on the plates 15 and 16. By locating the front wheels of the vehicle on the plates 15, the front pair of gripping means 14 will have with respect to the vehicle a proper position for gripping the elongated side body or chassis portions 29 at locations adjacent but to the rear of the front wheels. With the vehicle thus supported by the plates 15 and 16, the intermediate plates 21 are removed. At this time it is possible to displace the pair of lock means 13 to their unlocking positions so that the sleeves 13' can be longitudinally shifted along the beams 7 to locate the beams 12 and the pair of gripping means 14 carried thereby at desired locations along the chassis or body parts 29. Of course, when the sleeves 13' are shifted forwardly from the plates 16, the latter will remain supported by the wheels 17. At this time the several gripping means 14 are shifted laterally so as to become aligned with the body parts which are to be gripped.

Now, the operator makes certain that the locks 9 and 10 are in their unlocking positions. With these locks 9 and 10 thus being in their unlocking positions, the operator will admit fluid under pressure into the cylinder of hydraulic unit 8 so that the latter expands, and the entire vertically movable support means is raised with respect to the frame means 1 to assume an attitude as shown in dot-dash lines in FIG. 2 according to which the front plates 15 while resting on the parts 39' at the same time tilt to an increasing degree from their initial horizontal positions. The result is that the front pair of gripping means 14 come into engagement with the automobile to support the latter while the front end of the automobile continues to be raised until the front wheels no longer engage the plates 15. When the front wheels no longer engage the plates 15, the lock 10 is placed in its locking position and additional fluid under pressure is admitted to the unit 8 so as to expand the latter further, thus raising the ramp portion of the vertically movable support means until this ramp portion reaches a horizontal attitude. During this part of the operation the rear plates 16 continue to be supported by the wheels 17 so that the ramp portion swings upwardly with respect to the plates 16 which turn upwardly only at their rear portions which are pivotally connected to the beams 7 in the manner described above. This operation will place the rear pair of gripping means 14 in engagement with the body of the vehicle, at the parts 29 thereof, so that when the beams 7 and the remainder of the ramp portion are situated in their horizontal attitude the vehicle is supported by the several gripping means 14 and the wheels of the vehicle are no longer supported. Now the several nuts 27 are tightened so that the vehicle is firmly gripped to remain stationary with respect to the vertically movable support means. Of course, once the beams 7 have reached their horizontal attitude, the locks 9 are placed in a locking position to maintain the beams 7 in their horizontal attitude. At this time the vehicle can be raised to any desired elevation. The rear plates 20 swing down to assure that the vehicle remains aloft, depending upon the height thereof, and as was pointed out above suitable supports 19' may be situated in engagement with the lugs or stays 18 and 19 to maintain the vehicle at a desired elevation without requiring the full weight of the structure to be carried by the fluid in the unit 8. However, whenever vertical displacement of the vehicle is desired, these supports 19' can be removed after the vehicle is raised through a slight elevation, and the vehicle can be lowered or raised further as desired.

With the above-described parts of the structure of the invention in this position, the metal-deforming operations can go forward. If, for example, an automobile has been damaged in a crash in such a way that the front part of the vehicle at its outer skin plates and inner fenders together with their frame boxes have been bent toward the left and rearwardly, then the rectifying or metal-deforming operations can proceed along the following lines:

The lock 37 is placed in its unlocking position and by way of the unit 55 the sleeve 36 is moved along the beam 31 so as to locate the lateral beams 39 in such a position that the straightening means 42 are situated beneath the bent frame beams of the vehicle. The bars 42 which form the straightening means are laterally adjusted by way of the lateral moving means 54 so as to register properly with the damaged components of the vehicle. At the damaged side of the vehicle the straightening member 42 is raised to the height of the frame beam, and now the appropriate unit 54 is operated to cause the raised member 42 to act on the frame beam so as to push the latter in order to straighten the same.

Inasmuch as in the above example the upper part of the inner fender has also been pushed in, the rectifying head 52 is operated so as to apply a straight pulling force thereto from the inside. This is brought about by raising the rectifying head 52 to the proper height by way of vertical adjustment of the appropriate vertical member 46 while the horizontal member 50 is turned about the axis of the member 46 so as to situate the clamping means at a desired position. Now the appropriate hydraulic unit 54 is operated so that the required lateral movement will be carried out with the clamping means clamping the damaged vehicle part so that through the force derived from the unit 54 a suitable metal-deforming operation can be carried out to repair the damaged part. If longitudinal forces are required, the unit 55 is utilized for this purpose. This may require the lock 32 to be removed, for example. Additional pulling forces can be applied in a forward direction, if required, by way of the positioning means and clamping means carried by the beam 34.

When using a rectifying head 52, it is situated at the required height, and the lock 57 is unlocked. The lock 63 is also unlocked so that the cylinder 61 and the tube 64 thereon are free to rotate as indicated by the arrow 53 in FIG. 8. The clamping angle of the jaws 71 and 74 is adjusted by way of the pin 77' as described above. The lock 67 fixes the clamping means at the desired angular position with respect to the axis of the cylinder 61. Of course it is to be noted that during turning of the tube 79 the entire clamping means will turn therewith and the piston rod 72 will turn together with the piston within the cylinder of the unit 61. Because of all of these adjusting possibilities, the clamping jaws are able to clamp the edge or plate margin of the metal which is to be deformed irrespective of the direction in which this edge or plate margin extends. It is thus possible to set the clamping jaws, in the above example, to clamp the edge region of the inner fender with the force derived from the unit 61, and then the deforming operations will be carried out by way of the telescopic beam system described above.

Thus, the rectifying heads 52 may be used on any parts which require repair. With or without the clamping jaws, the rectifying head may be used to push and pull in any desired direction at the edges of door frames, windows, skirts, frames, inner and outer fenders, headlights, fixing frames, doors, etc. Since the rectifying head itself has straight as well as angular surfaces, these parts may be used in the deforming operations. Also, various rectifying tools in the form of bars having any desired configuration may be clamped in the clamping jaws so that through such tools it is possible to have access to relatively narrow spaces.

After one side of the automobile has been rectified, the gripping of this repaired side may remain in action while the rectifying or metal-deforming operations are then carried out at the other side of the vehicle. The length of the various deforming movements can of course be read from the various scales on the beams. In the event that the deforming operations have been carried out in such a way that it is found that further deforming operations are required to achieve a desired dimension, then of course the deforming operations are continued.

Thus, through the longitudinal moving means 55 it is possible to provide longitudinal pushing or pulling forces. Through the lateral moving means 54 it is possible to provide lateral pushing or pulling forces.

A particular feature of the invention resides in applying vertical pushing or pulling forces by way of the unit 8. Thus this vertical moving means 8 which acts on the vertically movable support means can also be used for providing vertical pushing or pulling forces. For this purpose the supporting blocks 19' are of course removed so that the elevation of the entire vehicle can be changed. The clamping means will remain in a position clamping the part to which a vertical pushing or pulling force is to be applied. In the alternative the clamping means may clamp a tool such as a suitably shaped bar which engages the part to which a vertical force is to be applied. Now through the vertical moving means 8 it is possible to displace the entire vehicle with respect to the clamped part thereof in a vertical direction to bring about the desired vertical pushing or pulling force. In the description above the various details described and shown are only illustrative of the inventive concept. Various embodiments of the invention of course may vary within the scope of the claims which follow. For example, the various locking mechanisms may be manually, electrically, or hydraulically operated. Moreover, the various hydraulic moving means can be replaced by other types of power means. Furthermore, all of the lowering plates such as the plates 15 and 16 may be made in such a way that they descend simultaneously at both ends, for example, with the aid of suitable guide rails.

What is claimed is:

1. In a metal deforming apparatus suitable for purposes such as automobile repairs, frame means, vertically movable support means operatively connected with said frame means for vertical movement with respect thereto, vertical moving means operatively connected with said vertically movable support means for moving the same vertically with respect to said frame means, gripping means carried by said vertically movable support means for gripping a structure such as the body of an automobile, for maintaining said structure stationary with respect to said vertically movable support means, so that by way of said vertical moving means, vertically movable support means, and gripping means it is possible to support a structure such as an automobile while placing it at a selected elevation with respect to said frame means, telescopic beam means carried by said frame means, having a horizontal axis, and capable of having its length changed, beam moving means operatively connected with said telescopic beam means for changing the length thereof, clamping means for clamping a structure such as a metal automobile part which is to be deformed or a tool for deforming a metal part, and positioning means carrying said clamping means and operatively connected with said beam means for situating said clamping means at a selected position with respect to said beam means, said beam moving means being operable to move said clamping means with respect to said support means for applying horizontal pushing or pulling forces to a part which is to be deformed while said vertical moving means is operable to move a structure with respect to clamping means for applying vertical pushing or pulling forces to a part which is to be deformed.

2. The combination of claim 1 and wherein a wheel means supports said frame means for travelling movement.

3. The combination of claim 1 and wherein said positioning means is operatively connected with said clamping means for displacing the latter about a horizontal axis.

4. The combination of claim 3 and wherein said positioning means is also operatively connected with said clamping means for displacing the latter about a vertical axis.

5. The combination of claim 1 and wherein said vertically movable support means includes a vertically movable portion operatively connected with said frame means for vertical movement with respect thereto and an elongated ramp portion pivotally connected to said vertically movable portion for turning movement with respect thereto about a horizontal axis, said ramp portion having an initial position inclined downwardly from said vertically movable portion for supporting a vehicle during travelling movement onto said ramp portion, said vertical moving means being operatively connected with said ramp portion for turning the latter to a horizontal attitude with respect to said vertically movable portion, releasable lock means for releasably locking said ramp portion to said vertically movable portion in said horizontal attitude, said vertical moving means then being operative for raising or lowering said vertically movable support means with respect to said frame means while said ramp portion remains locked in said horizontal attitude with respect to said vertically movable portion.

6. The combination of claim 5 and wherein said ramp portion includes plate means adapted to be situated beneath vehicle wheels while the body of the vehicle is gripped by said gripping means, said plate means being operatively connected with said ramp portion for movement away from a location beneath the vehicle wheels after the vehicle body is gripped by said gripping means, so that the vehicle is then supported through said gripping means on said vertically movable support means.

7. The combination of claim 1 and wherein said vertically movable support means includes a longitudinal beam means adapted to extend longitudinally of a vehicle situated over said vertically movable support means, and a plurality of lateral beams fixed to the latter longitudinal beam means and extending laterally therefrom, said gripping means including a plurality of gripping units respectively carried by said lateral beams, and each gripping unit including a first gripping jaw movable along a lateral beam a second gripping jaw pivoted to said first gripping jaw, a wedge situated between a part of said first gripping jaw and the lateral beam along which it is movable for wedging the first gripping jaw thereto, said wedge being formed with a bore passing therethrough, a bolt pivotally connected to said second gripping jaw and extending through said bore of said wedge, and a nut on said bolt for bringing said second jaw into gripping engagement with respect to said first jaw while simultaneously placing said wedge in wedging relationship between said first jaw and lateral beam on which the latter is mounted.

8. The combination of claim 7 and wherein a sleeve surrounds and is slidable along said longitudinal beam means of said vertically movable support means, said sleeve carrying at least one lateral beam so that the latter together with the gripping unit carried thereby are longitudinally adjustable.

9. The combination of claim 1 and wherein said telescopic beam means includes a pair of telescopic beam means respectively extending longitudinally and laterally with respect to an automobile gripped by said gripping means, one of said pair of beam means being fixedly carried by said frame means and the other of said pair of beam means being carried by said one telescopic beam means.

10. The combination of claim 9 and wherein said beam moving means includes a longitudinal moving means operatively connected with said longitudinal telescopic beam means for changing the length thereof and a lateral moving means operatively connected with said lateral telescopic beam means for changing the length thereof, said longitudinal moving means being operable for applying longitudinal pushing or pulling forces to said clamping means while said lateral moving means is operable for applying lateral pushing or pulling forces to said clamping means.

11. The combination of claim 10 and wherein said longitudinal telescopic beam means is carried by said frame means while said lateral telescopic beam means is carried by said longitudinal telscopic beam means.

12. The combination of claim 11 and wherein said positioning means is operatively connected with said lateral telescopic beam means and includes a vertically movable member, a guide guiding the latter member for vertical movement and a lock for releasably locking said vertically movable member at a selected elevation, said positioning means also including a horizontally movable member and a guide guiding said horizontally movable member for horizontal movement and a lock for releasably locking said horizontally movable member to said guide therefor in a selected horizontal position, the latter guide being carried by said vertically movable member for rotary movement about a vertical axis so that said horizontally movable member of said positioning means can be angularly oriented with respect to said vertical axis while being horizontally positioned with respect thereto, a sleeve turnable about said horizontal member which extends transversely with respect to said sleeve, a lock for locking said sleeve in a given angular position and said elongated member carrying distant from said sleeve a rotary member capable of rotating about the axis of said elongated member and a lock for locking said rotary member in a selected angular position to said elongated member, said rotary member carrying said clamping means.

13. The combination of claim 12 and wherein said clamping means includes a pair of clamping jaws, said rotary member carrying a pin extending across the axis of said rotary member and supporting said clamping jaws for turning movement about said pin, lock means for releasably locking one of said clamping jaws to said rotary member in a selected angular position with respect thereto, and moving means carried by said elongated member and operatively connected to the other of said clamping jaws for turning the latter to and from a clamping position with respect to said one clamping jaw.

14. The combination of claim 9 and wherein said lateral telescopic beam means carries a pair of straightening means movable laterally with respect to said lateral beam means and longitudinally with said lateral beam means upon a change in length of said longitudinal beam means, said pair of straightening means being adapted to act on parts gripped by said gripping means for straightening said parts.

15. The combination of claim 14 and wherein a means is operatively connected with said pair of straightening means for adjusting the elevation thereof.

16. The combination of claim 9 and wherein said lateral telescopic beam means carries a pair of rearwardly extending beams adapted to carry structure for operating on parts gripped by said gripping means and situated to the rear of said lateral telescopic beam means.

* * * * *